US005861710A

United States Patent [19]

Uchida et al.

[11] Patent Number: 5,861,710

[45] Date of Patent: Jan. 19, 1999

[54] COLOR CATHODE RAY TUBE WITH REDUCED MOIRE

[75] Inventors: Go Uchida; Shoji Shirai, both of Mobara; Kenichi Watanabe, Isumi-gun, all of Japan

[73] Assignee: Hitachi, Ltd., Tokyo, Japan

[21] Appl. No.: 778,100

[22] Filed: Jan. 2, 1997

[30] Foreign Application Priority Data

Jan. 8, 1996 [JP] Japan ..... 8-000779

[51] Int. Cl.[6] ..... H01J 29/46

[52] U.S. Cl. ..... 313/440; 313/414; 313/446

[58] Field of Search ..... 313/409, 412, 313/414, 415, 437, 440, 446

[56] References Cited

U.S. PATENT DOCUMENTS 3,731,129 5/1973 Tsuneta et al. ..... 313/403

3,943,281 3/1976 Keller et al. ..... 313/409

4,475,056 10/1984 Hirai ..... 313/403

5,382,883 1/1995 Chen et al. ..... 313/409

*Primary Examiner*—Vip Patel

*Attorney, Agent, or Firm*—Antonelli, Terry, Stout & Kraus, LLP

[57] ABSTRACT

A color cathode ray tube includes a panel portion with its inner surface coated with a phosphor film; and an in-line type electron gun having a cathode, a control electrode, an accelerating electrode, a focus electrode, and an anode for projecting three electron beams toward the phosphor film. The in-line type electron gun projects the three electron beams substantially in parallel to each other in a plane perpendicular to the major axis of the screen.

8 Claims, 9 Drawing Sheets

COLOR CATHODE RAY TUBE WITH REDUCED MOIRE

BACKGROUND OF THE INVENTION

The present invention relates to a color cathode ray tube having a three beam in-line type electron gun.

In general, a color cathode ray tube employs an electron gun configured to emit three in-line electron beams in a horizontal plane parallel to the major axis of a phosphor screen, and accommodated in a neck portion.

FIG. 7 is a schematic sectional view illustrating a configuration example of a prior art color cathode ray tube. In FIG. 7, reference numeral 30 indicates a panel portion; 31 is a neck portion; 32 is a funnel portion; 33 is a phosphor film; 34 is a shadow mask; 35 is a mask frame; 36 is a magnetic shield; 37 is a mask suspension mechanism; 38 is an electron gun; 39 is a deflection yoke; and 40 is a magnetic correction device. Also, reference character Bc indicates a center beam, and Bs is a side beam.

In the color cathode ray tube of this type, the panel portion 30 carrying a screen is connected to the neck portion 31 by means of the funnel portion 32, to form an evacuated envelope. The inner surface of the panel portion 30 is coated with the phosphor film 33, and the shadow mask 34 is suspended closely spaced from the phosphor film 33. The neck portion 31 accommodates the electron gun 38 for emitting three electron beams in a horizontal plane. The electron beams thus emitted from the electron gun 38 are deflected in the horizontal and vertical directions through deflection magnetic fields produced by the deflection yoke 39 disposed around the funnel portion 32, to scan the phosphor film 33, thus forming a desired image.

FIGS. 8A and 8B are views illustrating a configuration example of the electron gun accommodated in the neck portion of the color cathode ray tube shown in FIG. 7, wherein FIG. 8A is a horizontal sectional view of the electron gun, and FIG. 8B is a cross-sectional view taken along line VIIIB—VIIIB of FIG. 8A.

In FIG. 8A, reference numeral 11 indicates a heater; 12 is a cathode; 13 is a control electrode; 14 is an accelerating electrode; 15 is a focus electrode; 16 is an anode; 17 is a shield cup; 18 is an inner conductive coating coated on the inner wall of the neck portion 31; and 19 is a contact spring with one end thereof fixed on the shield cup 17 and the other end thereof pressed on the inner conductive film 18.

The operation of the color cathode ray tube accommodating the electron gun, shown in FIG. 7, will be described below.

Thermoelectrons emitted from the cathodes 12 heated by the heaters 11 are accelerated toward the control electrode 13 by the accelerating electrode 14, to form three electron beams Bc, Bs, and Bs.

These three electron beams each pass through apertures (beam-passing apertures) in the control electrode 13 and through beam-passing apertures in the accelerating electrode 14. The three electron beams are also subjected to a slight focusing action by a pre-focus lens formed between the accelerating electrode 14 and the focus electrode 15, and are accelerated by a voltage applied to the focus electrode 15 to enter a main lens formed between the focus electrode 15 and the anode 16.

The three electron beams are focused on the phosphor film 33 by the main lens, to form beam spots.

The main lens through which the side beams Bs pass is non-axially-symmetric, and it deflects the side beams Bs toward the tube axis such that the side beams Bs and the center beam Bc converge on the phosphor film 33. However, three electron beams do not converge at the center of the phosphor screen only by the structure of the electron gun because of tolerances in the manufacture of components, and accordingly they need to be converged at the center of the phosphor film 33 by adjustment of static convergence adjustment magnets for side beams and static convergence magnets for a center beam, which constitute the magnetic correction device 40.

A color image can be displayed by correctly superposing three color images of red (R), green (G) and blue (B) formed by means of three electron beams. Three electron beams are scanned over the phosphor screen through magnetic fields generated by the deflection yoke 39, to form an image.

In general, a self-converging deflection yoke is used as the deflection yoke 39.

In the case where the magnetic field of the deflection yoke is homogeneous, since the shape of the panel portion 30 carrying the screen of the cathode ray tube is not spherical with respect to the deflection center, three electron beams converged at the screen center do not stay converged when deflected.

To cope with such an inconvenience, the self-converging deflection yoke is so configured as to produce a magnetic field having an inhomogeneous distribution composed of a pin cushion-like horizontal magnetic deflection field distribution and a barrel-like vertical magnetic deflection field distribution, to obtain a self-convergence effect, thereby causing three electron beams to converge over the entire screen area.

The above-described color cathode ray tube has a disadvantage that since the magnetic field distribution of the self-convergent deflection yoke is inhomogeneous, focus characteristics deteriorate with an increasing deflection angle of electron beams and thereby resolution at the periphery of a screen is degraded as compared with that at the center of the screen.

To solve the above disadvantage, there have been known a method of applying a dynamic voltage varying with an increasing deflection angle of electron beams to a focus electrode, and a method as disclosed in Japanese Patent Laid-open No. Sho 61-250933, in which a focus electrode is composed of at least a first focus sub-electrode and a second focus sub-electrode, an electrostatic quardrupole lens is formed between facing ends of both the two focus sub-electrodes, and a dynamic voltage varying with an increasing deflection angle of electron beams is applied to the second focus sub-electrode.

The above-described methods are effective for eliminating an increase in beam spot diameter, but they distort beam spot shapes. One of causes of distortion of the beam spot shape is the shape of a panel portion being not spherical with respect to the deflection center and making the faceplate of the panel portion not perpendicular to the travelling direction of deflected electron beams.

FIGS. 9A and 9B are views illustrating the distortion of a beam spot shape associated with the shape of a panel portion of a cathode ray tube.

As shown in FIG. 9A, a spot of the electron beam on a phosphor film (or screen) forms a round shape when the electron beam is undeflected, but it forms an oval shape having the major axis along the deflection direction when the electron beam is deflected.

Accordingly, as shown in FIG. 9B, the beam spot shape on the screen is vertically elongated for vertically deflected beams, and is horizontally elongated for horizontally deflected beams.

Another cause of distortion of the beam spot shape is the inhomogeneous magnetic field distribution of the deflection yoke. The self-converging deflection yoke provides a pin cushion-like horizontal deflection magnetic field distribution shown in FIG. 10A and a barrel-like vertical deflection magnetic field distribution shown in FIG. 10B. As shown in FIGS. 10A and 10B both the deflection magnetic field distributions exert a horizontally elongating force on the deflected electron beams and thereby the beam spot shape on the screen is horizontally elongated as shown in FIG. 10C.

FIGS. 10A and 10B are views illustrating the distortion of a beam spot shape caused by a deflection yoke. FIG. 10A shows the influence of a horizontal deflection magnetic field, and FIG. 10B shows the influence of a vertical deflection magnetic field. Character X indicates the horizontal direction; Y is the vertical direction; B (vector) is a horizontal or vertical deflection magnetic field; I (vector) is the travelling direction of electron beams; and F (vector) is a force exerted on electron beams.

The actual beam spot shape on the screen is formed by a combination of the effects shown in FIGS. 9B and 10C, so that in the case of the vertically deflected beams, these effects cancel out each other to form a relatively round beam spot shape; while in the case of the horizontally deflected beams, these effects reinforce each other to form an extremely horizontally elongated spot shape.

As a result, there arises a problem that the vertical diameter of each of the beam spots at the right and left edges on the screen (phosphor film) becomes very small, thereby causing raster moire.

Moire is a phenomenon that a stripe pattern occurs on the screen due to interference between horizontal scanning lines and a periodic structure of three color phosphor dots forming the screen, to thereby degrade resolution. When the beam spot diameter becomes smaller than a value determined by the periodic structure of the phosphor dots, moire is caused.

SUMMARY OF THE INVENTION

An object of the present invention is to solve the above-described problems with the prior art devices and to provide a color cathode ray tube capable of displaying a high quality image by suppressing occurrence of moire at the periphery of the screen without degrading focus characteristics.

To achieve the above object, according to the present invention, there is provided a color cathode ray tube including: a panel portion having a screen of a phosphor film coated on an inner surface thereof; and an in-line type electron gun including at least a cathode, a control electrode, an accelerating electrode, a focus electrode, and an anode for projecting three electron beams toward the screen; wherein the in-line type electron gun projects the three electron beams substantially in parallel to each other in a plane perpendicular to the major axis of the screen such that the three electron beams converge to a common area, on the phosphor film.

To achieve the above object, according to the present invention, there is also provided a color cathode ray tube including: a panel portion having a screen of a phosphor film coated on an inner surface thereof; a shadow mask disposed closely spaced from the screen; an in-line type electron gun including at least a cathode, a control electrode, an accelerating electrode, a focus electrode, and an anode for projecting three electron beams toward the screen; and a deflection yoke disposed between the screen and the in-line type electron gun; wherein the in-line type electron gun projects the three electron beams substantially in parallel to each other in a plane perpendicular to the major axis of the screen such that the three electron beams converge to a common area on the phosphor film; and a horizontal deflection magnetic field formed by the deflection yoke for deflecting the three electron beams in a direction of the major axis of the screen has a barrel-like distribution, and a vertical deflection magnetic field formed by the deflection yoke for deflecting the three electron beams in a direction perpendicular to the major axis of the screen has a pin cushion-like distribution.

BRIEF DESCRIPTION OF THE DRAWINGS

In the drawings, which form an integral part of the specification and are to be read in conjunction therewith, and in which like reference numerals designate similar components throughout the figures, and in which:

FIGS. 2A and 2B are views illustrating a configuration example of an electron gun of the color cathode ray tube shown in FIG. 1, wherein FIG. 2A is a vertical sectional view of the electron gun; and FIG. 2B is a cross-sectional view taken along line IIB—IIB of FIG. 2A;

FIGS. 3A and 3B are views illustrating another configuration example of the electron gun of the color cathode ray tube shown in FIG. 1, wherein FIG. 3A is a vertical sectional view of the electron gun, and FIG. 3B is a cross-sectional view taken along line IIIB—IIIB of FIG. 3A;

FIGS. 4A and 4B are views illustrating a further configuration example of the electron gun of the color cathode ray tube shown in FIG. 1, wherein FIG. 4A is a vertical sectional view of the electron gun, and FIG. 4B is a cross-sectional view taken along line IVB—IVB of FIG. 4A;

FIGS. 8A and 8B are views illustrating a configuration of an electron gun accommodated in a neck portion of the color cathode ray tube shown in FIG. 7, wherein FIG. 8A is a horizontal sectional view of the electron gun, and FIG. 8B is a cross-sectional view taken along line VIIIB—VIIIB of FIG. 8A;

FIGS. 9A and 9B are views illustrating the distortion of a beam spot shape associated with the shape of a panel portion of the prior art cathode ray tube, wherein FIG. 9A shows the deflection of electron beams, and FIG. 9B shows beam spot shapes on a screen; and FIGS. 10A, 10B and 10C are views illustrating the distortion of a beam spot shape caused by a magnetic field, wherein FIG. 10A shows a beam spot distortion caused by a horizontal deflection magnetic field; FIG. 10B shows a beam spot distortion caused by a vertical deflection magnetic field; and FIG. 10C shows beam spot shapes on a screen.

DETAILED DESCRIPTION OF THE PREFERRED EMBODIMENTS

Hereinafter, preferred embodiments of the present invention will be described with reference to the accompanying drawings.

Figure 1:
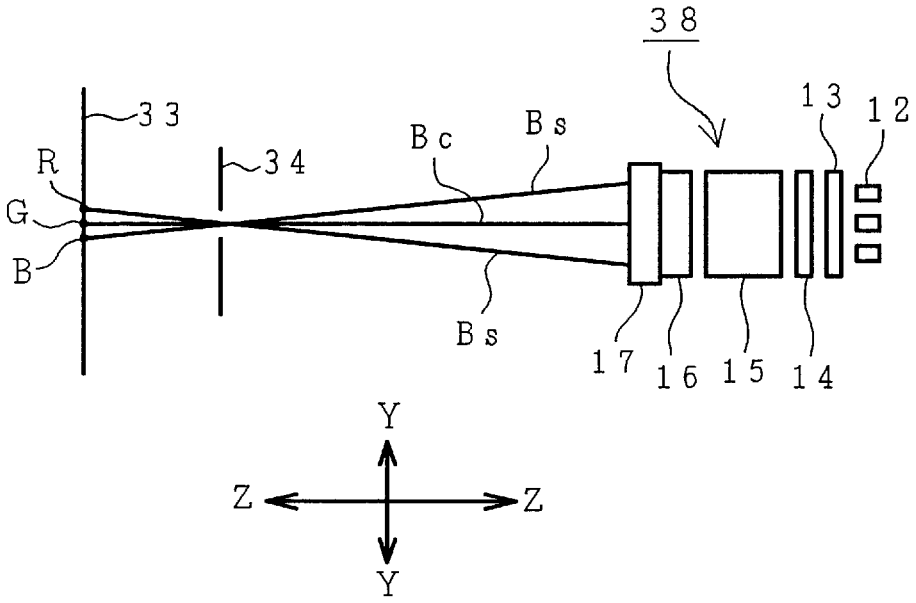
FIG. 1 is a schematic view illustrating an embodiment of a color cathode ray tube of the present invention.

FIG. 1 is a schematic view illustrating an embodiment of a color cathode ray tube of the present invention. In this figure, reference numeral 12 indicates a cathode; 13 is a control electrode; 14 is an accelerating electrode; 15 is a focus electrode; 16 is an anode; 17 is a shield cup; 33 is a phosphor film forming a screen; 34 is a shadow mask; and 38 is an electron gun. Also, reference character Bc indicates a center beam; Bs is a side beam; R is a red phosphor element; G is a green phosphor element; and B is a blue phosphor element. In addition, Y—Y indicates the vertical direction, and Z—Z indicates the tube axis direction.

In FIG. 1, a screen of the phosphor film 33 comprising spaced-apart three-color phosphor elements is formed in a rectangular shape having the major axis in the horizontal direction (X—X direction), and three electron beams Bc, Bs, and Bs are arranged in a plane parallel to the Y—Y direction of the screen.

Figure 2A:
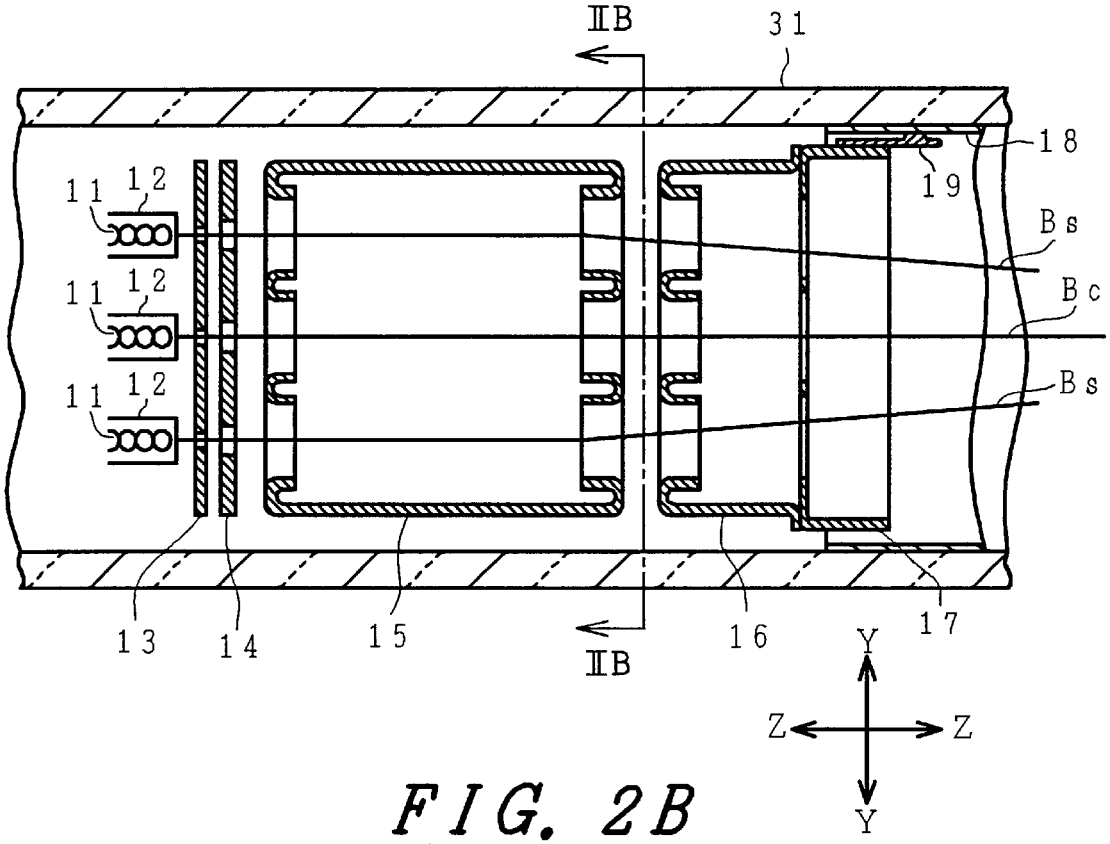
Figure 2B:
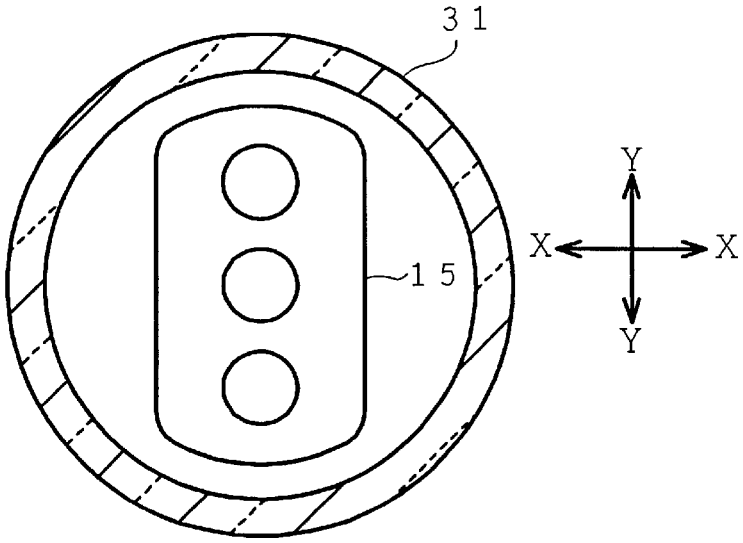

FIGS. 2A and 2B are views illustrating a configuration example of the electron gun of the color cathode ray tube shown in FIG. 1, wherein FIG. 2A is a vertical sectional view of the electron gun, and FIG. 2B is a front view, taken at line IIB—IIB of FIG. 2A, showing the focus electrode. Reference numeral 18 indicates an inner conductive coating, and 19 is a contact spring.

In FIG. 2A, each heater 11 is supplied with a potential of from 5 to 10 V; each cathode 12 is supplied with a cathode potential corresponding to a video signal; the control electrode 13 is supplied with a control electrode potential of about from 0 to −200 V; and the accelerating electrode 14 is supplied with an accelerating electrode potential of from 200 to 1000 V.

The focus electrode 15 is supplied with a focus electrode potential of from 5 to 10 kV, which is, in some cases, superposed with a dynamic voltage varying with an increasing deflection angle of electron beams.

The anode 16 is supplied with an anode potential of from about 20 to about 35 kV from the inner conductive film 18 through the contact spring 19 with one end thereof fixed on the shield cup 17.

According to the color cathode ray tube accommodating the electron gun having the above-described configuration, a beam spot shape is not horizontally elongated but vertically elongated at the right or left edge of the screen, so that raster moire hardly appears.

Moreover, since the deflection angle corresponding to the top or bottom of the screen is small, the distortion of the beam spot is small, and accordingly, the resolution is improved over the entire screen area.

Figure 3A:
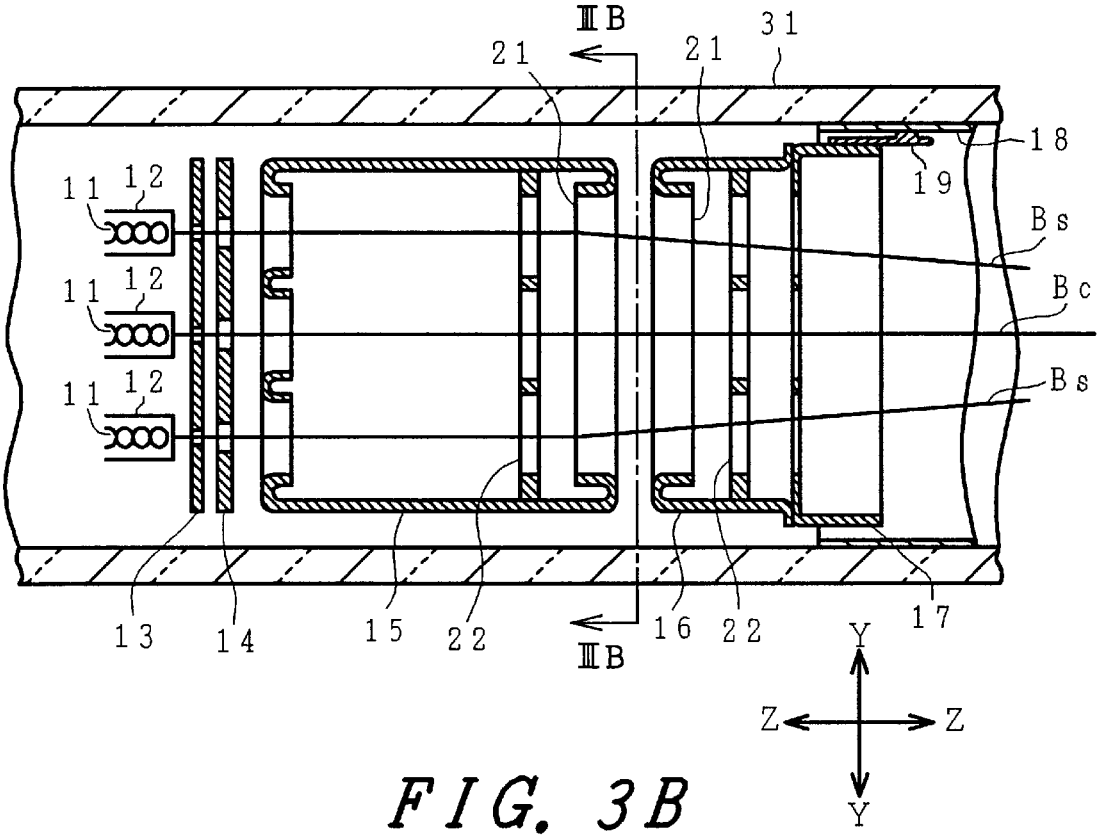
Figure 3B:
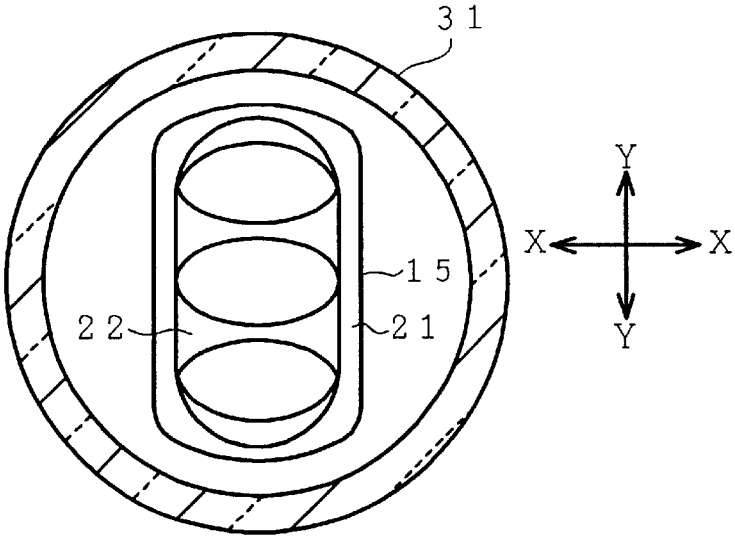

FIGS. 3A and 3B are views illustrating another configuration of the electron gun of the color cathode ray tube shown in FIG. 1, wherein FIG. 3A is a vertical sectional view of the electron gun, and FIG. 3B is a front view, taken at line IIIB—IIIB of FIG. 3A, showing the focus electrode.

In this example, each of the focus electrode 15 and the anode 16 which form a main lens of the electron gun is composed of an electrode 21 and a plate electrode 22 disposed in the focus electrode 15 or the anode 16. The electrode 21 is formed with a single opening having a vertical diameter larger than a horizontal diameter and allowing three electron beams to pass therethrough, and the plate electrode 22 has beam-passing apertures.

In the color cathode ray tube including the electron gun having the above-described configuration also, the beam spot shape at the right and left peripheries of the screen is vertically elongated, so that raster moire hardly appears.

Moreover, since the deflection angle corresponding to the top or bottom of the screen is small, the distortion of the beam spot is small, and accordingly, the resolution is improved over the entire screen area.

Figure 4A:
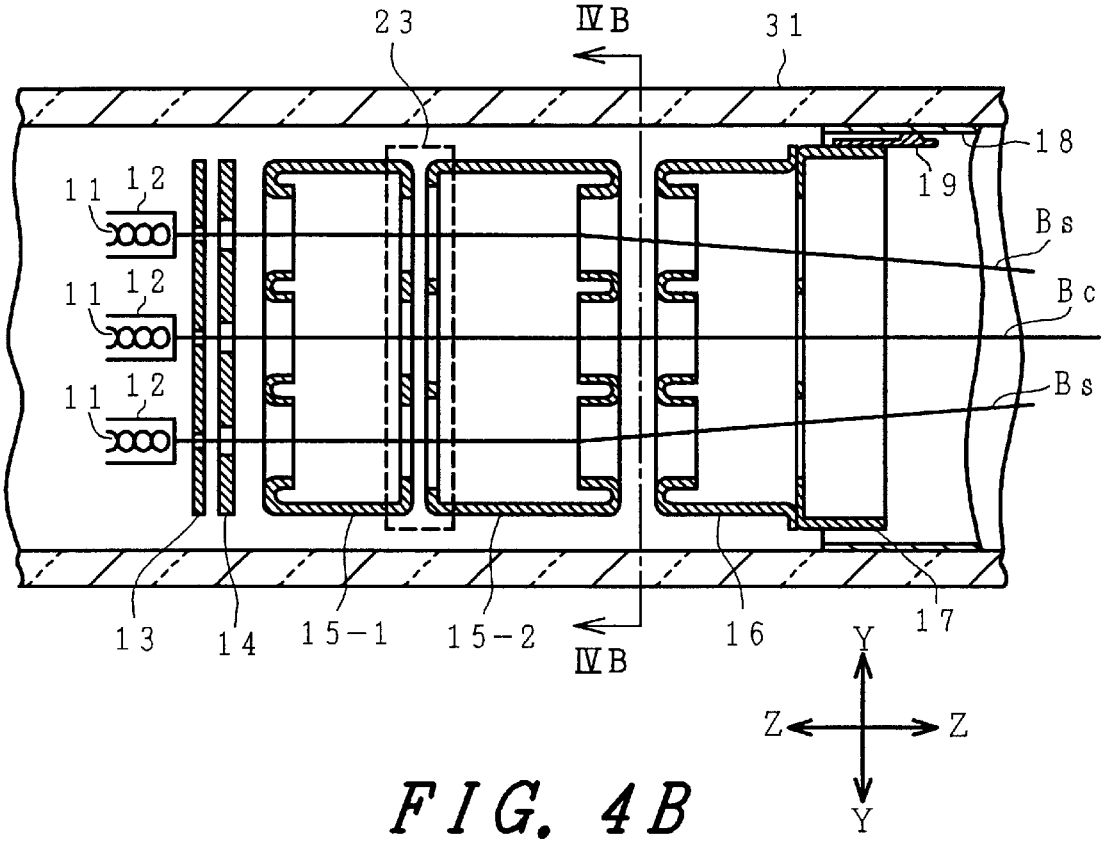
Figure 4B:
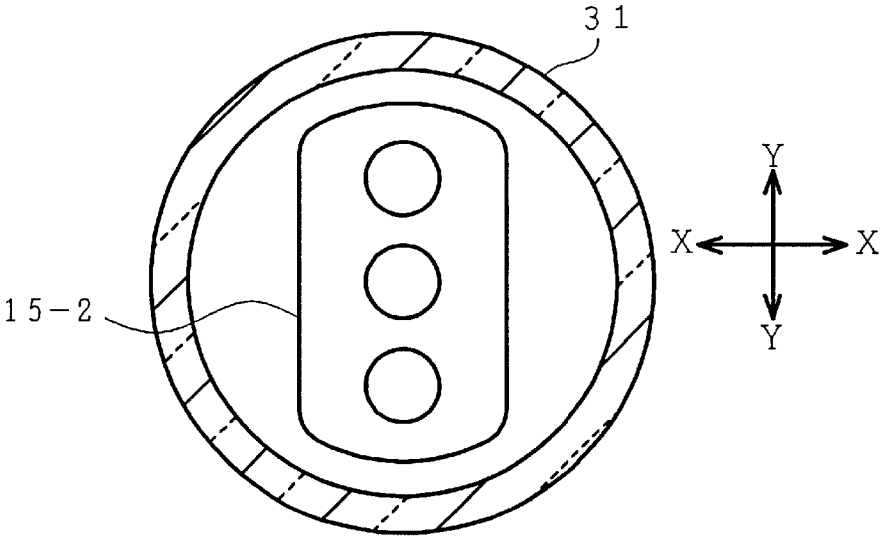

FIGS. 4A and 4B are views illustrating a further configuration of the electron gun of the cathode ray tube shown in FIG. 1, wherein FIG. 4A is a vertical sectional view of the electron gun, and FIG. 4B is a front view, taken at line IVB—IVB of FIG. 4A, showing the focus electrode.

In this example, the focus electrode is composed of a first focus sub-electrode 15-1 and a second sub-electrode 15-2, and an electrostatic quardrupole lens 23 is formed between the opposing ends of the two focus sub-electrodes by provision of three horizontally elongated beam-passing apertures in the first focus sub-electrode 15-1 on the end thereof facing the second focus sub-electrode 15-2, and three vertically elongated beam-passing apertures in the second sub-electrode 15-2 on the end thereof facing the first focus sub-electrode 15-1, wherein a dynamic voltage varying with a deflection angle of electron beams is applied to the second focus sub-electrode 15-2.

In the color cathode ray tube including the electron gun having the above-described configuration also, the beam spot shape at the right and left peripheries of the screen is vertically elongated, so that raster moire hardly appears.

Moreover, since the deflection angle corresponding to the top or bottom of the screen is small, the distortion of the beam spot is small, and accordingly, the resolution is improved over the entire screen area.

Next, a configuration of the phosphor screen of the color cathode ray tube employing the electron gun in each example will be described.

Figure 5:
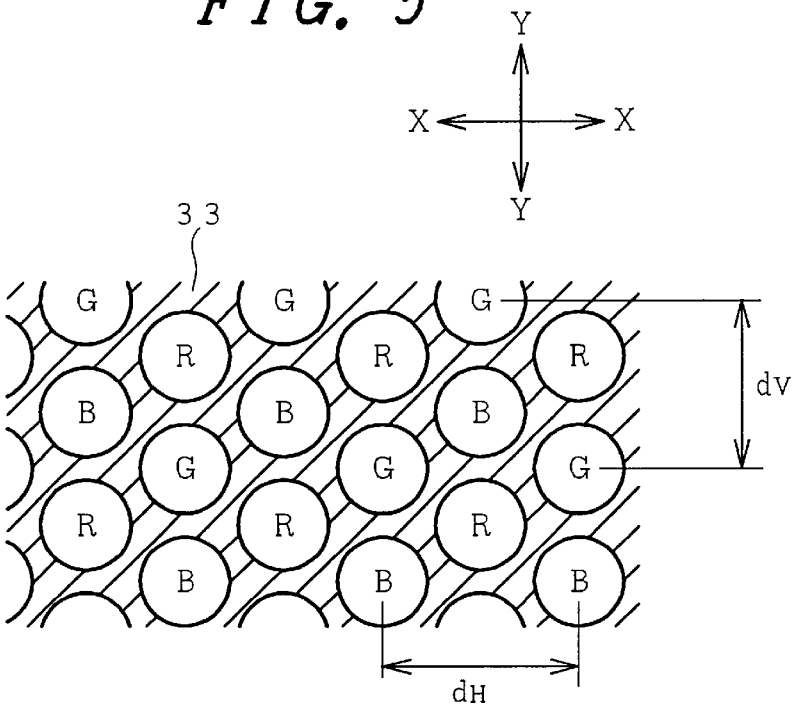
FIG. 5 is a detailed plan view illustrating one example of a phosphor screen of the color cathode ray tube of the present invention.

FIG. 5 is a detailed plan view illustrating one example of the phosphor screen of the color cathode ray tube of the present invention. In this figure, reference character R indicates a red phosphor element; G is a green phosphor element; B is a blue phosphor element; $d_V$ is a vertical period between phosphor elements of the same color; and $d_H$ is a horizontal period between phosphor elements of the same color.

As shown in FIG. 5, since each of the phosphor elements R, G and B is formed in a dot shape, the period $d_V$ in the vertical direction (Y—Y direction) is small and it can be made substantially equal to the period $d_H$ in the horizontal direction (X—X direction), with the result that there does not occur a difference in moire visibility compared with phosphor elements of the stripe type, thereby ensuring a high quality image display.

Figure 6:
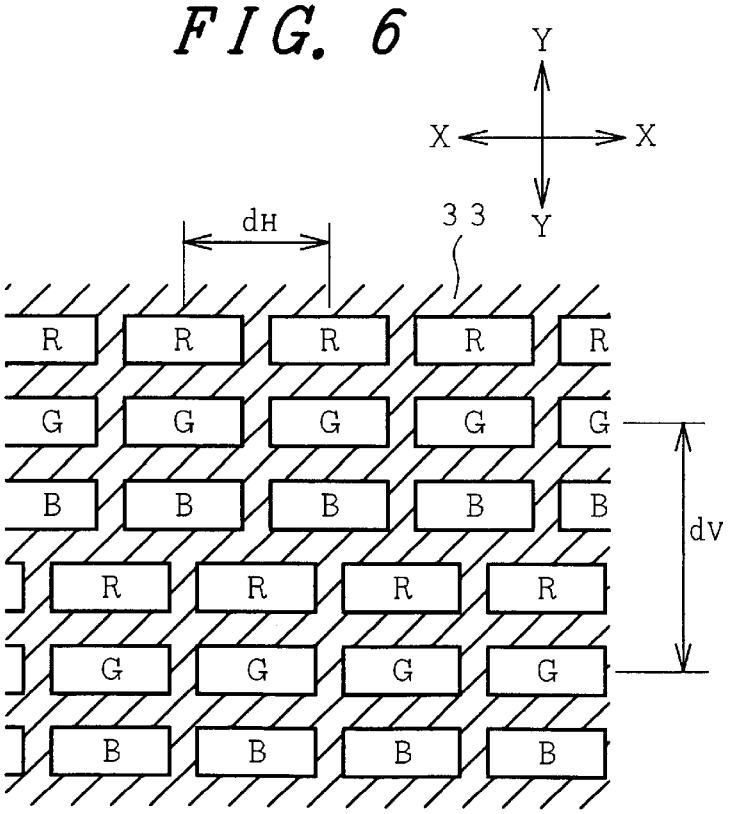
FIG. 6 is a detailed plan view illustrating another example of the phosphor screen of the color cathode ray tube of the present invention.
Figure 7:
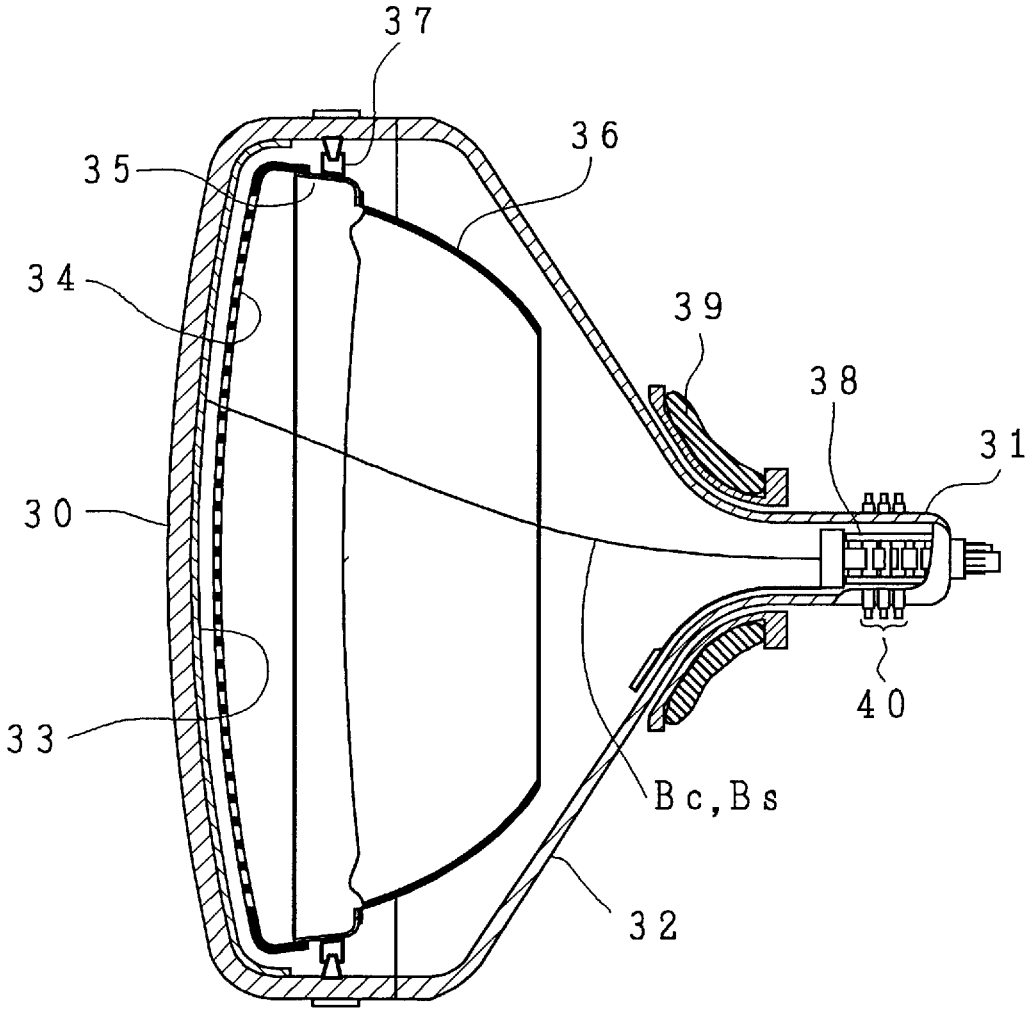
FIG. 7 (PRIOR ART)
FIG. 7 is a schematic sectional view illustrating a configuration example of a prior art color cathode ray tube.
Figure 8A:
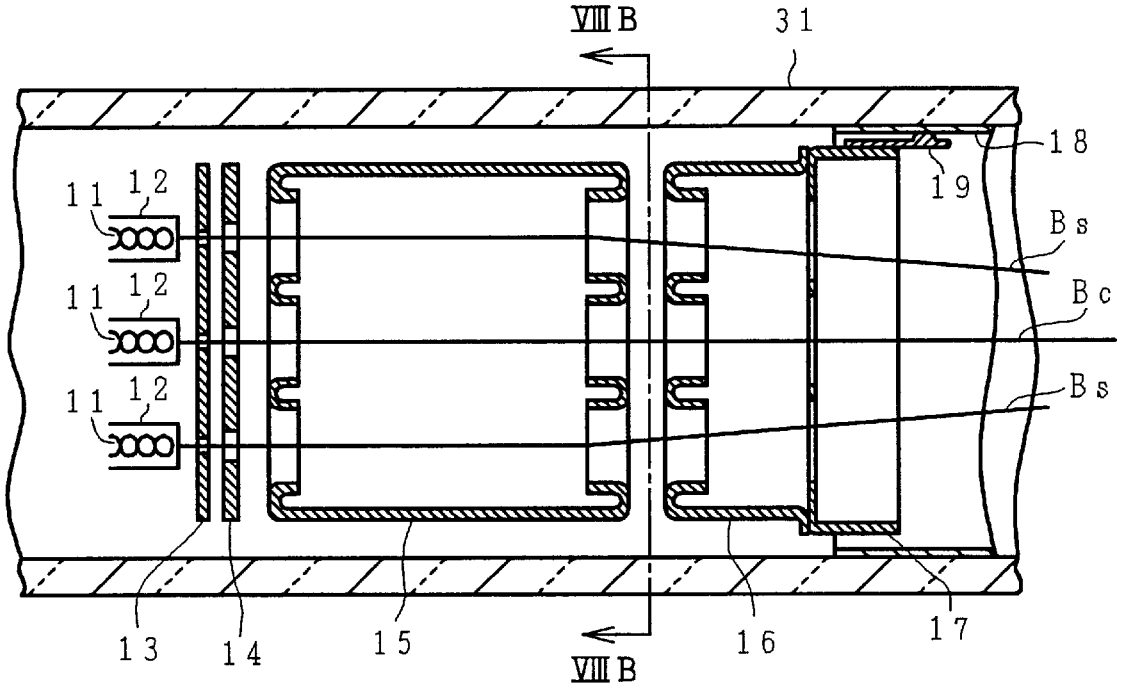
FIG. 8A (PRIOR ART)
Figure 8B:
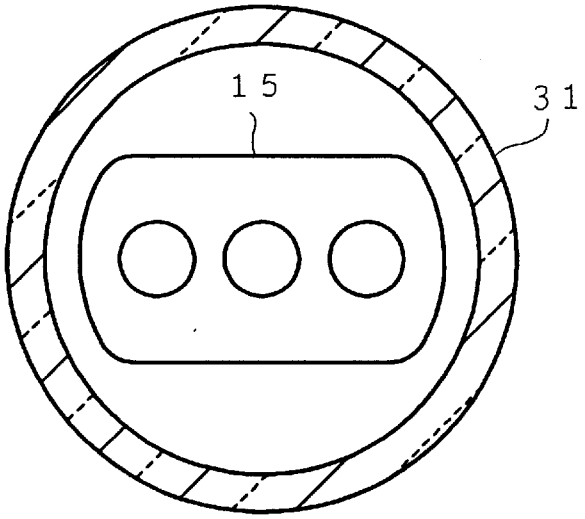
FIG. 8B (PRIOR ART)
Figure 9A:
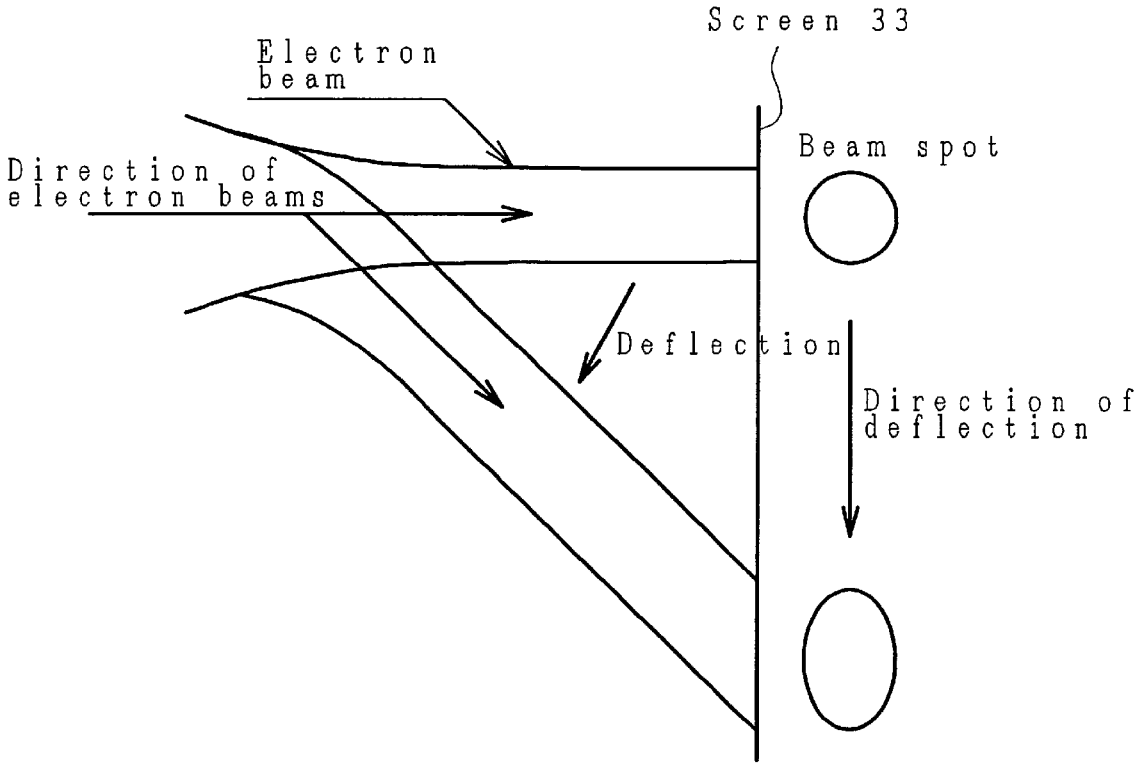
Figure 9B:
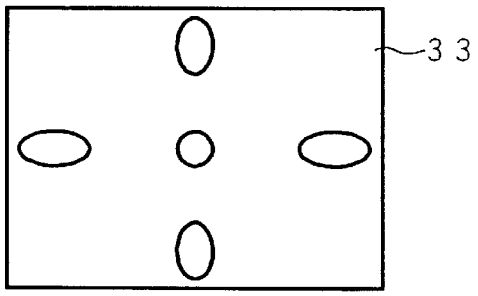
Figure 10A:
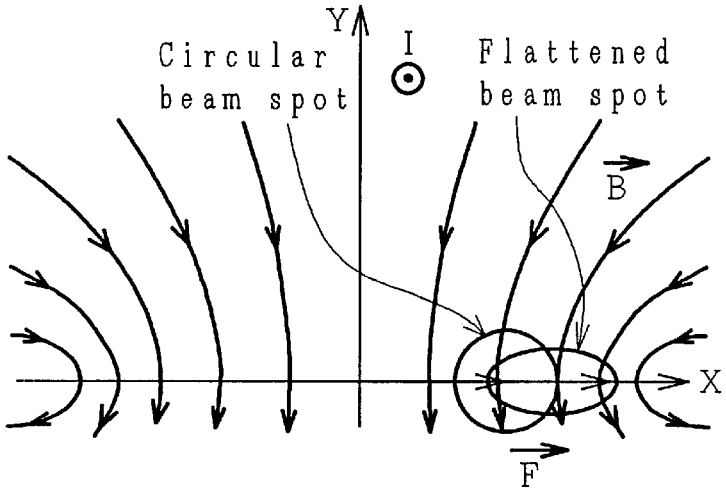
Figure 10B:
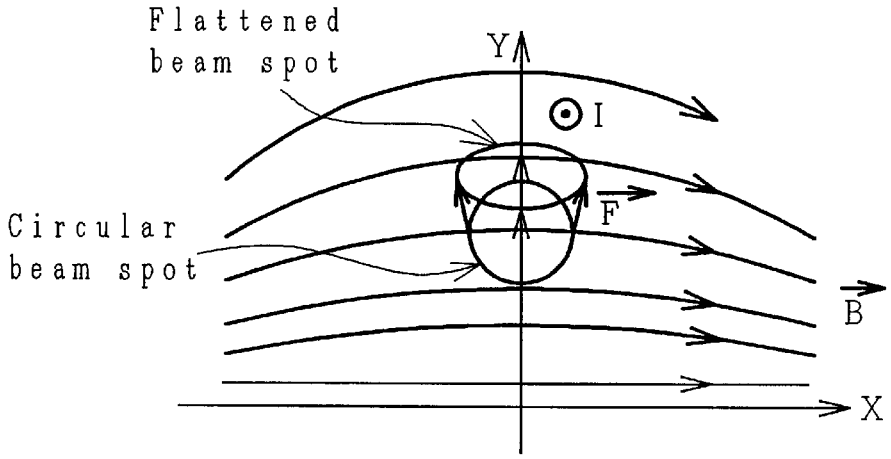
Figure 10C:
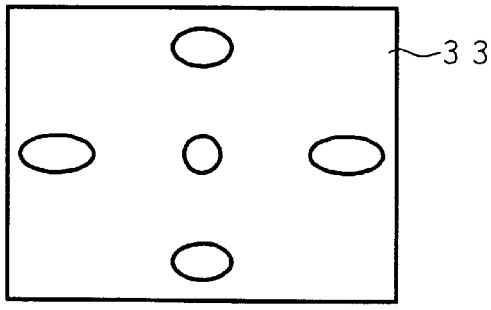

FIG. 6 is a detailed plan view of a further example of the phosphor screen of the color cathode ray tube of the present invention. Since an aperture of the shadow mask is formed in a slot, the period $d_V$ in the vertical direction (Y—Y direction) is larger than the period $d_H$ in the horizontal direction (X—X direction) for each of the phosphor elements R, G and B. In this example also, it is possible to suppress the occurrence of moire by adjustment of vertical and horizontal lengths of a phosphor stripe.

As described, by arranging three in-line electron beams emitted from an in-line electron gun in a vertical plane perpendicular to the major axis of a screen, and rotating the magnetic field distribution of a self-converging deflection yoke 90 degrees about the tube axis as compared with the conventional one such that the horizontal deflection magnetic field distribution is barrel-shaped and the vertical deflection magnetic field is pin cushion-shaped, the distortion of the shape of electron beam spot rotates 90 degrees so that the beam spot is vertically elongated at the top or bottom of the screen and becomes approximately round at the left or right edge of the screen. As a result, the vertical diameter of the beam spot does not become small at locations near the righthand and lefthand periphery of the screen, and thereby suppressing raster moire.

Moreover, since the aspect ratio of the screen is 4:3 or 16:9, the vertical deflection angle is smaller than the horizontal deflection angle, with the result that the vertical distortion of the beam spot shape becomes smaller than the conventional horizontal distortion of the beam spot shape.

Accordingly, the resolution over the entire screen is significantly improved as compared with the conventional one. In particular, the effect becomes pronounced for the color cathode ray tube having the aspect ratio of 16:9 as compared with the color cathode ray tube having the aspect ratio of 4:3.

According to the present invention, there can be provided a color cathode ray tube capable of displaying a high quality image by suppressing occurrence of moire at the periphery of the screen without degrading focus characteristics.

What is claimed is:

1. A color cathode ray tube comprising:

a panel portion having a screen comprised of a phosphor film coated on an inner surface of the panel portion; and an in-line type electron gun including at least a cathode, a control electrode, an accelerating electrode, a focus electrode, and an anode for projecting three electron beams toward said screen;

wherein said in-line type electron gun projects said three electron beams substantially in parallel to each other in a plane perpendicular to a major axis of said screen, and wherein said three electron beams converge on a common area on said phosphor film.

2. A color cathode ray tube comprising:

a panel portion having a screen comprised of a phosphor film coated on an inner surface of the panel portion;

a shadow mask disposed closely spaced from said screen;

an in-line type electron gun including at least a cathode, a control electrode, an accelerating electrode, a focus electrode, and an anode for projecting three electron beams toward said screen; and a deflection yoke disposed between said screen and said in-line type electron gun;

wherein said in-line type electron gun projects said three electron beams substantially in parallel to each other in a plane perpendicular to a major axis of said screen, and wherein said three electron beams converge on a common area on said phosphor film.

3. A color cathode ray tube according to claim 2, wherein electron beam apertures of said shadow mask are formed in a dot shape.

4. A color cathode ray tube according to claim 2, wherein electron beam apertures of said shadow mask is formed in a rectangular shape having a major axis in said direction of said major axis of said screen.

5. A color cathode ray tube comprising:

a panel portion having a screen comprised of a phosphor film coated on an inner surface of the panel portion; and an in-line type electron gun including at least a cathode, a control electrode, an accelerating electrode, a focus electrode, and an anode for projecting three electron beams toward said screen;

wherein said in-line type electron gun projects said three electron beams substantially in parallel to each other in a plane perpendicular to a major axis of said screen, and wherein said in-line type electron gun further includes a main lens for converging the three electron beams on a common area of the phosphor film to trace a single scanning line at a time on said screen.

6. A color cathode ray tube comprising:

a panel portion having a screen comprised of a phosphor film coated on an inner surface of the panel portion;

a shadow mask disposed closely spaced from said screen;

an in-line type electron gun including at least a cathode, a control electrode, an accelerating electrode, a focus electrode, and an anode for projecting three electron beams toward said screen; and a deflection yoke disposed between said screen and said in-line type electron gun;

wherein said in-line type electron gun projects said three electron beams substantially in parallel to each other in a plane perpendicular to a major axis of said screen, wherein said in-line type electron gun further includes a main lens for converging the three electron beams on a common area of the phosphor film, and wherein said deflection yoke operates in conjunction with the in-line type electron gun to trace a single scanning line at a time, formed from said three electron beams, on the screen; and a horizontal deflection magnetic field formed by said deflection yoke for deflecting said three electron beams in a direction of said major axis of said screen has a barrel-like distribution, and a vertical deflection magnetic field formed by said deflection yoke for deflecting said three electron beams in a direction perpendicular to said major axis of said screen has a pin cushion-like distribution.

7. A color cathode ray tube according to claim 6, wherein electrode beam apertures of said shadow mask are formed in a dot shape.

8. A color cathode ray tube according to claim 6, wherein electron beam apertures of said shadow mask is formed in a rectangular shape having a major axis in said direction of said major axis of said screen.

* * * * *